US005212838A

United States Patent [19]

Davidson et al.

[11] Patent Number: 5,212,838

[45] Date of Patent: May 25, 1993

[54] MOLDED PLASTIC CAP BUCKLE AND ADJUSTMENT STRAP

[75] Inventors: Raymond G. Davidson, Batavia; Rodney C. Shadwick, Chicago, both of Ill.

[73] Assignee: Handy Button Machine Company, Melrose Park, Ill.

[21] Appl. No.: 809,702

[22] Filed: Dec. 17, 1991

[51] Int. Cl.[5] ..... A42B 1/22

[52] U.S. Cl. ..... 2/197; 2/199; 2/417; 2/418; 24/580

[58] Field of Search ..... 2/181, 171.4, 171.7, 2/171.8, 183, 195, 197, 199, 417, 418; 24/580, 581

[56] References Cited

U.S. PATENT DOCUMENTS

| | | | |
|---|---|---|---|
| 2,616,089 | 11/1952 | Berg | 2/197 |
| 2,629,103 | 2/1953 | Berg | 2/197 |
| 2,742,646 | 4/1956 | Berg | 2/197 |
| 2,822,549 | 2/1958 | Glass | 2/199 |
| 2,857,601 | 10/1958 | Goldman | 2/199 |
| 3,253,281 | 5/1966 | Benner | 2/417 |
| 3,950,788 | 4/1976 | Lamb | 2/417 |
| 4,292,692 | 10/1981 | Moretti | 2/418 |
| 4,999,846 | 3/1991 | Ball | 2/418 |

*Primary Examiner*—Clifford D. Crowder
*Assistant Examiner*—Diana L. Biefeld
*Attorney, Agent, or Firm*—Allegretti & Witcoff, Ltd.

[57] ABSTRACT

A molded plastic cap buckle and adjustment strap are provided for adjusting the circumference of the head band of a cap to adjust the cap to the head of a user. The buckle is secured to one end of the head band of the cap and the adjustment strap is secured at the other end of the head band. The buckle is made from a unitary member having parts hinged together along an elongated axis that lies generally parallel to the longitudinal axis of the adjustment strap. The buckle and strap have cooperating recesses and projections for securing the buckle and strap in selected adjusted position. The recesses and projections are constructed to provide for one-way longitudinal movement of the strap relative to the buckle in one direction when the buckle and strap are assembled to reduce the effective circumference of the head band, but preclude longitudinal movement in the opposite direction.

8 Claims, 2 Drawing Sheets

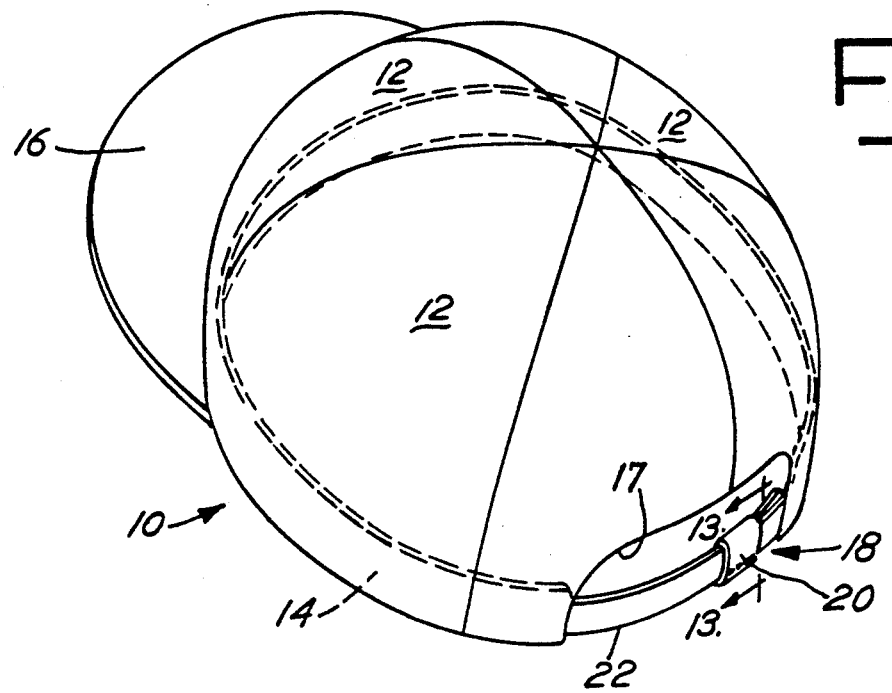
Fig.1
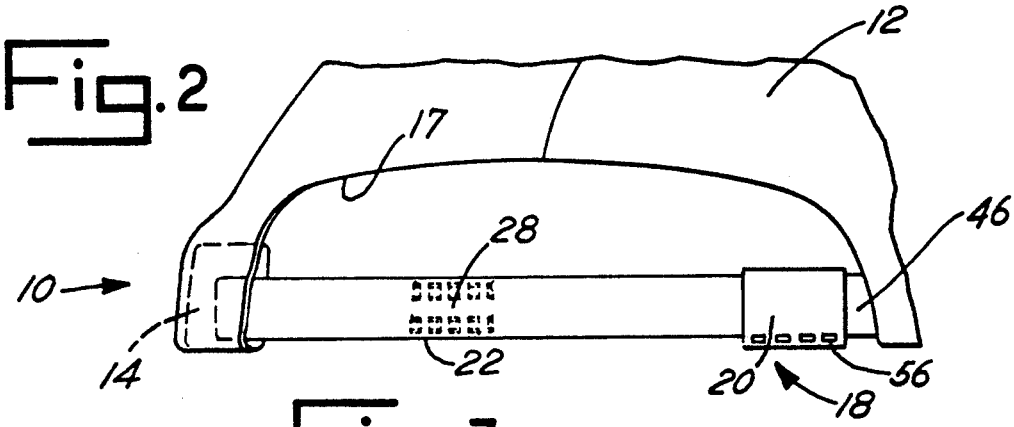
Fig.2
Fig.3
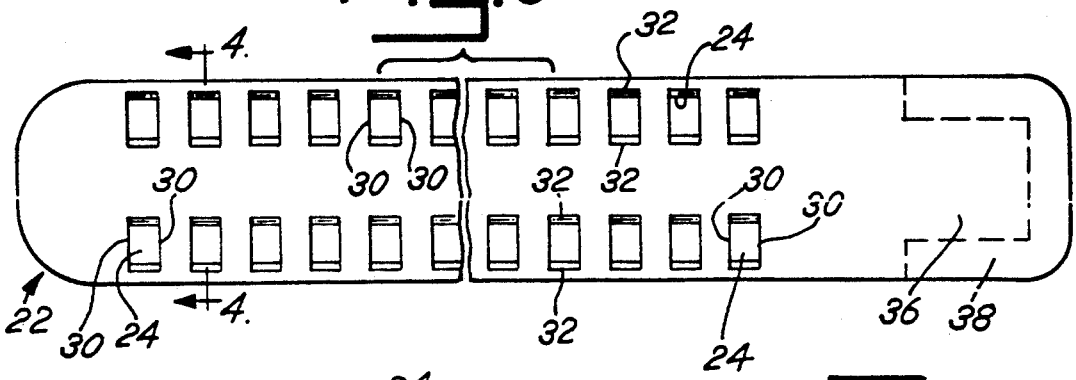
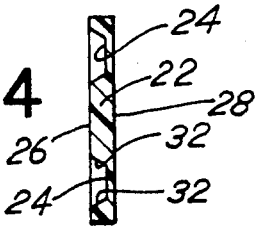
Fig.4
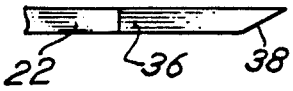
Fig.5

MOLDED PLASTIC CAP BUCKLE AND ADJUSTMENT STRAP

BACKGROUND OF THE INVENTION

This invention pertains to an adjustable band for a cap, for example, a baseball or tennis cap and more particularly, to a molded plastic cap buckle and adjustment strap for adjusting the circumference of the cap to the head of the user.

There are presently two basic types of head band adjustment mechanisms in use. One type includes an elongated strap made of leather, imitation leather or plastic having a row of longitudinally aligned openings therethrough affixed at one end, e.g., by a rivet to a cap and having a free end. A metal retainer or buckle secured to the cap, e.g., by a rivet, includes a pivoted pin adapted to engage in one of the openings in the strap for holding the strap in adjusted position. Riveting is an alien operation to most cap manufacturers, who basically perform cutting and sewing. Further, riveting is slow and costly. The other type of head band adjustment mechanism for a cap includes a plastic strap sewn at one end to the cap and having a portion with a line of projections extending from one side thereof and a second plastic strap secured at one end to the cap, e.g., by sewing, and having a line of openings therethrough. The circumference of the head band is adjusted by positioning the projections on one strap in selected openings in the other strap.

The use of a rivet to secure parts of the adjustment mechanism to the cap is labor intensive and expensive. The use of molded plastic is less expensive than the use of a two-piece metal buckle, however, until now, no plastic buckle with adequate strength, adjustability and durability has been developed. Adjustment of the known plastic adjustment mechanism described above requires considerable manual dexterity and may be difficult for some persons. Neither of the known head band adjustment mechanisms will permit one way longitudinal movement of the assembled parts relative to one another to provide for simple adjustment of the head band circumference.

An object of the present invention is to provide an improved adjustment mechanism for a head band of a cap wherein disadvantages and deficiencies of known constructions are obviated.

Another object of this invention is to provide a molded plastic cap buckle and adjustment strap for a head band of a cap that are relatively simple in construction and easy to use so as to provide for one-way adjustment of the head band so that the buckle and strap can be tightened but will not loosen.

Yet another object of the present invention is to provide a molded plastic cap buckle adapted to be detachably engaged to a molded plastic strap, the buckle and strap being connected so as to permit circumference reducing adjustment of the head band when the buckle and strap are connected.

Still another object of the present invention is to provide a unique molded plastic buckle for an adjustment mechanism for caps that is far less costly than a metal buckle and can be readily sewn into a cap.

Yet another object of the present invention is to provide a one-piece molded plastic buckle for an adjustment mechanism that has a right angle opening along a long hinge line, providing a strong, durable, yet readily adjustable buckle. Other objects and advantages of the present invention will be made more apparent hereinafter.

BRIEF DESCRIPTION OF THE DRAWINGS

There is shown in the attached drawing a presently preferred embodiment of the present invention wherein like numerals refer to like elements in the various views and wherein:

FIG. 1 is a perspective view of a cap including the molded plastic buckle and adjustment strap of the present invention;

FIG. 2 is a detail view of the cap from the rear thereof better illustrating the buckle and adjustment strap;

FIG. 3 is a top view of the adjustment strap;

FIG. 4 is a cross-section of the adjustment strap taken generally along line 4—4 of FIG. 3;

FIG. 5 is a detail view of the sewing projection of the adjustment strap;

DETAILED DESCRIPTION OF THE INVENTION

Figure 6:
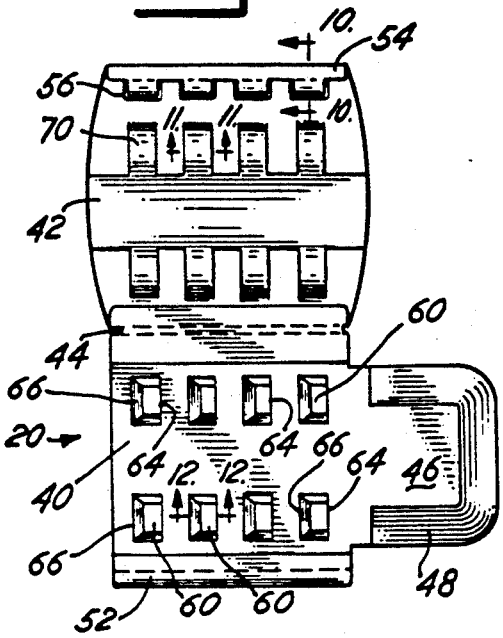
FIG. 6 is a top view of the buckle.
Figure 7:
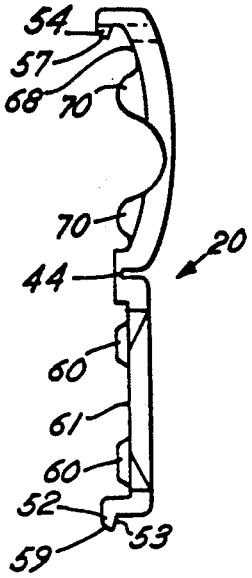
FIG. 7 is a side view of the buckle.
Figure 8:
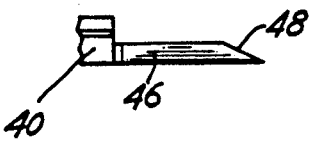
FIG. 8 is a detail view of the sewing projection of the buckle.
Figure 11:
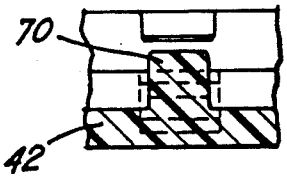
FIG. 11 is a detail view of the buckle taken along line 11—11 of FIG. 6.
Figure 9:
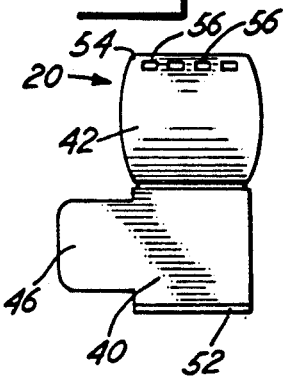
FIG. 9 is a bottom view of the buckle, on a reduced scale.
Figure 10:
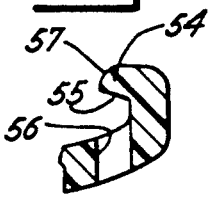
FIG. 10 is a detail view of the retention flange of the buckle taken along line 10—10 of FIG. 6.
Figure 12:
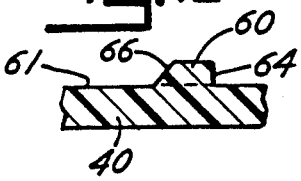
FIG. 12 is a detail view of a locking cog or projection on one part of the buckle, taken along line 12—12 of FIG. 6.

There is shown in FIGS. 1 and 2 a cap 10 made in a conventional manner from segments 12 of cloth or plastic sewn together to form a crown for covering the head of a user, and including a head band 14 sewn into the crown, and a visor 16 secured to the front of the cap. Secured to the head band 14 of the cap 10 at the rear is the adjustment mechanism 18 of the present invention. The adjustment mechanism 18, which is positioned in opening 17 at the rear of the cap 10, includes a cap buckle 20 and an elongated adjustment strap 22 that cooperates with the cap buckle 20 to adjust the effective circumference of the head band 14 and there by adjust the cap to the head of the user. The cap buckle 20 and the adjustment strap 22 are each molded from plastic to provide a unique adjustment mechanism as will become more apparent hereinafter.

With reference to FIGS. 3–5, it is seen that the elongated adjustment strap 22 has a plurality of recesses 24 formed in one side 26. The other side 28 is flat. The recesses 24 are arranged in two substantially parallel rows disposed longitudinally of the strap 22. The opposed sides 30 of each recess 24 that are generally transverse or perpendicular to the longitudinal axis of the strap 22 are generally perpendicular to the surface 26. The opposed sides 32 of each recess 24 that are generally parallel to the longitudinal axis of the strap 22 are at an angle with respect to the surface 26. In one presently preferred embodiment, the side 32 lie at an angle of 30° with respect to a line perpendicular to the surface 26.

The strap 22 has a sewing projection or tab 36 at one end for securing the strap 22 to the cap. The perimeter of the sewing tab 36 is chamfered or tapered as shown at 38.

The side 28 of strap 22, which normally would be exposed to viewer, may be decoratively textured, for example, to resemble leather or another material so as to enhance the appearance of the cap.

The construction of the cap buckle 20 may best be understood by reference to FIGS. 6–12. The cap buckle 20 includes a unitary or one piece body formed of parts 40 and 42 that are hingedly or pivotally connected at 44 along adjacent sides. The relatively long hinge 44 provides for strength of connection between the parts of the body. The orientation of the hinge parallel to the longitudinal axis of the strap 22 enables opening of the buckle of right angles to the longitudinal axis of the strap 22. The part 40 includes a projection or tab 46 by means of which the cap buckle 20 may be secured to the cap at one side of the opening 17. A presently preferred means for securing tab 46 to the head band 14 is by sewing. The sewing tab 46 is chamfered about the perimeter as best seen at 48 in FIGS. 7 and 8.

The sides of parts 40 and 42 of the cap buckle 20 are formed with complementary connecting means for securing the cap buckle 20 to the adjustment strap 22. Such connecting means comprise a flange 52 extending along the side of part 40 opposite the hinged side and a cooperating retention flange 54 on part 42. The retention flange 54 is generally C-shaped in cross-section and is adapted to snap over and retain the flange 52. Cored slots 56 are provided in the part 42 adjacent the retention flange 54 from enhancing the deformation of the retention flange 54 with respect to the part 42 to facilitate engagement of the retention flange 54 with the flange 52 when it is desired to secure the cap buckle 20 to the adjustment strap 22.

The part 40 has projection 60 extending upwardly from the surface 61. The projections 60 are arranged in two parallel rows of four. Each projection 60 is formed with one side 64 that defines a shoulder that lies generally perpendicular with surface 61. The top of the projection 60 is flat. The other three sides are tapered. The sides or surface 66 of each projection 60 lies opposite the side 64. As seen in FIG. 6, the projections 60 are in two generally longitudinally disposed parallel rows, with projections arranged in the two rows aligned transversely. Further, the surfaces 66 of the projections 60 are all disposed facing in the same direction, i.e., they all facing away for sewing tab 46, as seen in FIG. 6. The projections 60 provide one-way locking cogs as will be more fully explained hereinafter.

The part 42 has a generally curved cross-section. Extending from the surface 68 of the part 42 are projections 70. The projections 70 each have a generally hemispherical shape and are arranged in two rows complementary to the projections 60 on the part 40. It will be understood that the parts 40 and 42 will be positioned on opposite sides of the elongated strap in use. The projections 60 on part 40 will engage in a like number of cooperating recesses 24 in strap 22. Then the part 42 of the cap buckle 20 will be secured to part 40 and projections 70 will engage the surface 28 of the strap 22 to firmly secure the cap buckle 20 in engagement with the strap 22. The side 64 of each locking cog or projection 60 will engage a side 30 of an engaging recess 24. Retrograde motion between the cap buckle 20 and adjustment strap 22 is precluded. There can be no longitudinal motion between the cap buckle 20 and strap 22 to increase the circumference of the head band.

However, it is a unique feature of the construction of the adjustment mechanism of the present invention to permit adjustment of the strap 22 relative to the cap buckle 20 to permit reduction in the circumference of the head band, even when the cap buckle 20 is secured to strap 22. This is accomplished by means of urging the strap 22 longitudinally relative to the cap buckle in a direction to reduce the effective circumference of the cap. Tapered surfaces 66 on projections 60 function as cam surfaces to move each projection 60 on part 40 out of a cooperating recess 24 in strap 22. The strap 22 will move longitudinally with respect to the cap buckle 20 to reduce the circumference of the head band. The projection 60 on the part 40 of cap buckle 20 will engage the next group of recesses 24 in the strap 22 to lock the adjustment mechanism in the selected adjustment position.

Though the part 40 has been shown with eight projections 60, it will be understood that a lesser number, e.g., six, can be used to accomplish the desired locking and adjustment features of this invention. The projections 60 may be spaced apart longitudinally a center-to-center distance of 3/16 inch. The cooperating recesses 24 are similarly spaced apart longitudinally. Thus, longitudinal adjustments of 3/16 inch can be made.

Figure 13:
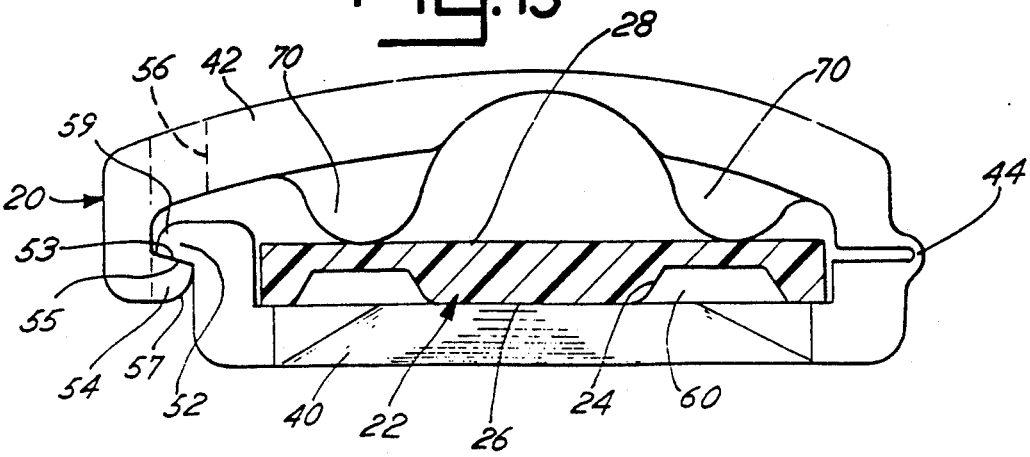
FIG. 13 is a cross-section through the assembled buckle and adjustment strap, taken generally along line 13—13 of FIG. 1.

FIG. 13 illustrates the cap buckle 20 in locking engagement with strap 22. Projections 60 on part 40 of cap buckle 20 are engaged in recesses 24 of strap 22. Projections 70 on part 42 of cap buckle 20 engage the surface 28 of strap 22 to help retain the cap buckle 20 and strap 22 is a selected adjusted position. Also, FIG. 13 illustrates the cooperative relationship between flanges 52 and 54. The ends of the flanges 52 and 54 are provided with cooperating camming surfaces. Since the parts 40 and 42 are molded from plastic there is an inherent resiliency which enables the retention flange 54 to snap over the flange 52 and then for the surfaces 53 and 55 on the flanges 52 and 54, respectively, to engage with one another to hold the cap buckle 20 on strap 22. The parts 40 and 42 are made from plastic, such as polyethylene, which is strong and durable, yet provides the needed resiliency to accommodate the snap fit cooperation of flanges 52 and 54. Also, the parts 40 and 42 are constructed as noted above to accommodate the one-way longitudinal motion between the cap buckle 20 and strap needed to adjust the circumference of the head band of the cap.

The curved concave or dome-like configuration of part 42 of cap buckle 20 is useful for facilitating opening of the buckle. The cap buckle 20 can be opened by pressing in the center of part 42. The flanges 52 and 54 will be released from one another to enable the cap buckle 20 to be opened. The plastic cap buckle 20 is fabricated from one piece and is less costly than known two piece metal buckles. The cap buckle 20 opens at right angles with respect to the strap. This allows easier sewing of the cap buckle 20 to the cap then compared to constructions that would open parallel to the strap. Further, the right angle opening in relation to the strap creates a stronger hinge area for a one piece plastic molded buckle to provide a more positive and stronger locking of the adjustment strap to the buckle.

While we have shown a presently preferred embodiment of the present invention, it will be understood that various changes and modifications may be made in the invention and it is intended that the invention will be limited only within the scope of the appended claims.

We claim:

1. A molded plastic cap buckle and adjustment strap for adjusting the circumference of a cap band comprising an elongated strap adapted to be secured at one end to said cap band, a plurality of recesses on one side of the elongated strap, the recesses being aligned longitudinally of the elongated strap, and a one-piece buckle having two parts integrally and pivotally secured to one another along one edge of each part and adapted to be engaged on opposite sides of the elongated strap, one part of the buckle having a projection adapted to be secured to said cap band, means for detachably connecting the two parts of the buckle together, said one part of the buckle having projections thereon adapted to engage with selected recesses in the elongated strap for securing the buckle and strap together in an adjusted position, said one part of the buckle having a flange along the edge opposite the pivotally connected edge thereof and said other part of the buckle having a retention flange along the edge opposite the pivotally connected edge thereof, the retention flange cooperating with said flange for detachably securing the two parts of the buckle together.

2. A molded plastic cap buckle and adjustment strap as in claim 1 wherein slots are provided in said other part of the buckle adjacent the retention flange.

3. A molded plastic cap buckle and adjustment strap as in claim 1 wherein the elongated strap has a longitudinal axis and the two parts are pivotally secured along a long hinge line that is generally parallel to the longitudinal axis of the elongated strap.

4. A molded plastic cap buckle and adjustment strap for adjusting the circumference of a cap band comprising an elongated strap adapted to be secured at one end to said cap band, a plurality of recesses on one side of the elongated strap, the recesses being aligned longitudinally of the elongated strap, and a one-piece buckle having two parts integrally and pivotally secured to one another along one edge of each part and adapted to be engaged on opposite sides of the elongated strap, one part of the buckle having a projection adapted to be secured to said cap band, means for detachably connecting the two parts of the buckle together, said one part of the buckle having projections thereon adapted to engage with selected recesses in the elongated strap for securing the buckle and strap together in an adjusted position the projections on said one part of the buckle cooperating with the recesses in the elongated strap to permit longitudinal movement of the elongated strap within the buckle in one longitudinal direction, but to preclude longitudinal movement in the opposite direction.

5. A molded plastic cap buckle and adjustment strap as in claim 4 wherein each of the projections on said one part of the buckle include one face that is at an angle with the surface of said one part from which the projections extend.

6. A molded plastic cap buckle and adjustment strap as in claim 5 wherein said angle is on the order of 50°.

7. A molded plastic cap buckle and adjustment strap for adjusting the circumference of a cap band comprising an elongated strap adapted to be secured at one end to said cap band, a plurality of recesses on one side of the elongated strap, the recesses being aligned longitudinally of the elongated strap, and a buckle having two parts pivotally secured to one another along one edge of each part and adapted to be engaged on opposite sides of the elongated strap, one part of the buckle having a projection adapted to be secured to said cap band, means for detachably connecting the two parts of the buckle together, said one part of the buckle having projections thereon adapted to engage with selected recesses in the elongated strap for securing the buckle and strap together in an adjusted position, the projections on said one part of the buckle cooperating with the recesses in the elongated strip to permit longitudinal movement of the elongated strap within the buckle in one longitudinal direction, but to preclude longitudinal movement in the opposite direction.

8. A molded plastic cap buckle and adjustment strap for adjusting the circumference of a cap band comprising an elongated strap adapted to be secured at one end to said cap band, a plurality of recesses on one side of the elongated strap, the recesses being aligned longitudinally of the elongated strap, and a buckle having two parts pivotally secured to one another along one edge of each part and adapted to be engaged on opposite sides of the elongated strap, one part of the buckle having a projection adapted to be secured to said cap band, means for detachably connecting the two parts of the buckle together, said one part of the buckle having projections thereon adapted to engage with selected recesses in the elongated strap for securing the buckle and strap together in an adjusted position, said one part of the buckle having projections thereon adapted to engage with selected recesses in the elongated strap for securing the buckle and strap together in an adjusted position, said one part of the buckle having a flange along the edge opposite the pivotally connected edge thereof and said other part of the buckle having a retention flange along the edge opposite the pivotally connected edge thereof, the retention flange cooperating with said flange for detachably securing the two parts of the buckle together.

* * * * *